US005379560A

United States Patent [19]

Steller

[11] Patent Number: 5,379,560

[45] Date of Patent: Jan. 10, 1995

[54] BANDED WINDOW SASH

[75] Inventor: Timothy J. Steller, Brooklyn, Mich.

[73] Assignee: Quick Plastics, Jackson, Mich.

[21] Appl. No.: 150,868

[22] Filed: Nov. 12, 1993

[51] Int. Cl.[6] ..... E06B 1/04

[52] U.S. Cl. ..... 52/204.7; 52/204.51; 49/380; 49/504

[58] Field of Search ..... 52/213, 217, 204.51, 52/208, 204.56, 204.62, 204.7, 222, 656.2, 656.5; 49/504, DIG. 2, 380

[56] References Cited

U.S. PATENT DOCUMENTS

| | | | |
|---|---|---|---|
| 4,180,944 | 1/1980 | Stowik et al. . | |
| 4,674,246 | 6/1987 | Giguere | 52/204.51 |
| 4,691,477 | 9/1987 | Governale . | |
| 4,805,326 | 2/1989 | Rainone et al. . | |
| 4,850,141 | 7/1989 | Pacca . | |
| 4,958,468 | 9/1990 | Nolan | 52/204.51 |
| 5,038,537 | 8/1991 | Frambach | 52/204.51 |

FOREIGN PATENT DOCUMENTS

| | | | |
|---|---|---|---|
| 2150187 | 6/1985 | United Kingdom | 52/204.51 |
| 2150188 | 6/1985 | United Kingdom | 52/204.51 |
| 2227275 | 7/1990 | United Kingdom | 52/204.7 |

*Primary Examiner*—Carl D. Friedman
*Assistant Examiner*—Creighton Smith
*Attorney, Agent, or Firm*—Harness, Dickey & Pierce

[57] ABSTRACT

An extruded plastic frame window sash in which the frame has a closed hollow body cross section with a recess extending into the hollow body from the outer periphery of the frame. The individual frame members are held together around a window pane by a tensioned band disposed within the recess and engaging each of the frame members. The tension band extends about the entire sash frame and is joined together at its end to maintain the tension in the band holding the frame together. The walls of the recess reinforce the frame members to prevent deflection induced by the tensioned band.

17 Claims, 2 Drawing Sheets

BANDED WINDOW SASH

BACKGROUND AND SUMMARY OF THE INVENTION

The present invention relates to a window sash structure and in particular to a window sash structure made of extruded plastic frame members held together by a tensioned band about the periphery of the sash.

A variety of materials have been used in window sash construction, most notably wood and metal. The use of each of these materials in a window sash presents certain problems. Wood sashes require constant maintenance in the form of painting to prevent rotting of the wood. Metal frames provide a high degree of thermal conductivity that results in excessive condensation on the inside of the sash during winter months. A metal frame sash does have the advantage of being able to be extruded with an irregular shape in a single manufacturing process. As such, a metal frame has an advantage over a wood frame which may require several manufacturing steps to form the frame into the necessary shape.

To overcome the problems associated with both wood and metal frames, extruded plastic frame members have been developed which provide the manufacturing ease associated with an extruded metal frame but without the disadvantage of condensation associated with a metal frame. However, joining the individual frame members together at the corners of the window sash has remained a difficulty with the plastic frame sash. One method of joining the frame members is the use of an adhesive. However, this is a time consuming process and it is difficult to form a strong joint with the small surface area available. In addition, disassembly of the sash for repair of broken glass is difficult or impossible with an adhesively joined frame. The use of screw fasteners is also difficult with a thin wall hollow extruded frame because there is little material available for the screw threads to bite into to form a secure connection. To provide the necessary material for a quality screw joint requires a significant increase in the amount of plastic material used throughout the entire length of the extrusion when only a small portion of that material would actually be needed for the screws at a joint. The excessive material usage significantly increases the cost of the frame.

Accordingly, it is an object of the present invention to provide an improved method of joining plastic frame members in a window sash.

It is a feature of the present invention to extrude the frame members with a recess along the outer periphery which extends inwardly into the hollow section of the frame member. The frame is held together by a tensioned band disposed in the recess, firmly engaging the frame members and extending around the periphery of the sash. The recess about the periphery is formed by a pair of spaced intermediate walls extending from the outer wall of the frame members into the hollow interior of the frame members. A base wall at the bottom of the recess connects the two intermediate walls to one another. The spaced intermediate walls of the recess act to strengthen the frame member by increasing its bending resistance and enabling the frame member to withstand the load applied to the frame members by the tensioned band used to hold the frame together.

In a preferred form of the invention, the tensioned band is made of plastic for corrosion resistance and for ease of assembly. The two ends of the band are joined to one another by a welding process in which the ends are heated to melt the two ends together. For repair of broken glass, the band is simply cut allowing the frame to come apart. A replacement band is then applied to secure the frame members around the replacement glass.

Further objects, features and advantages of the invention will become apparent from a consideration of the following description and the appended claims when taken in connection with the accompanying drawings.

DETAILED DESCRIPTION OF THE EMBODIMENT

Figures 1, 2:
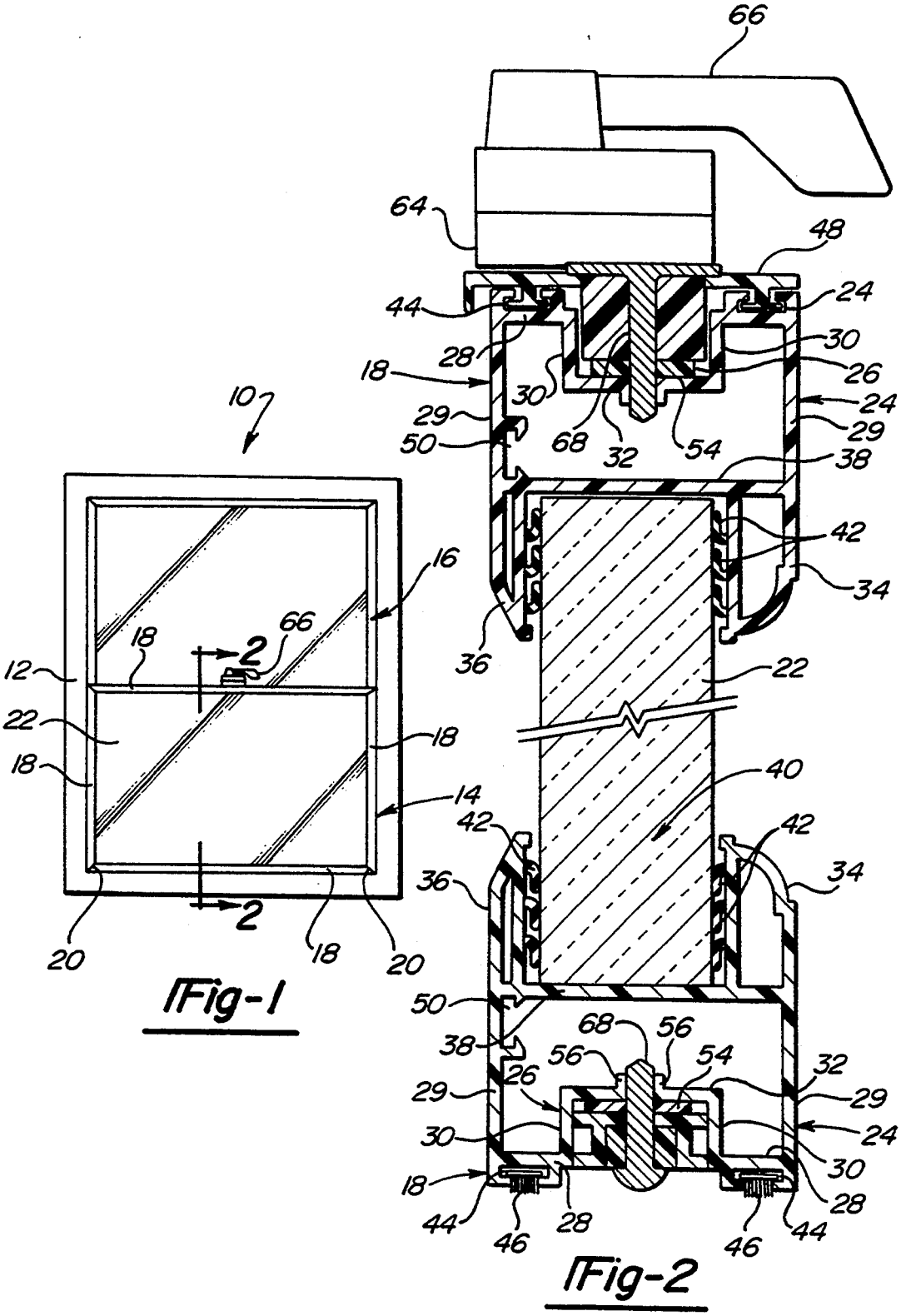
FIG. 1 is an elevational view of a double hung window employing sashes constructed according to the present invention.
FIG. 2 is a sectional view of the lower sash as seen from substantially the line 2—2 of FIG. 1.
Figure 3:
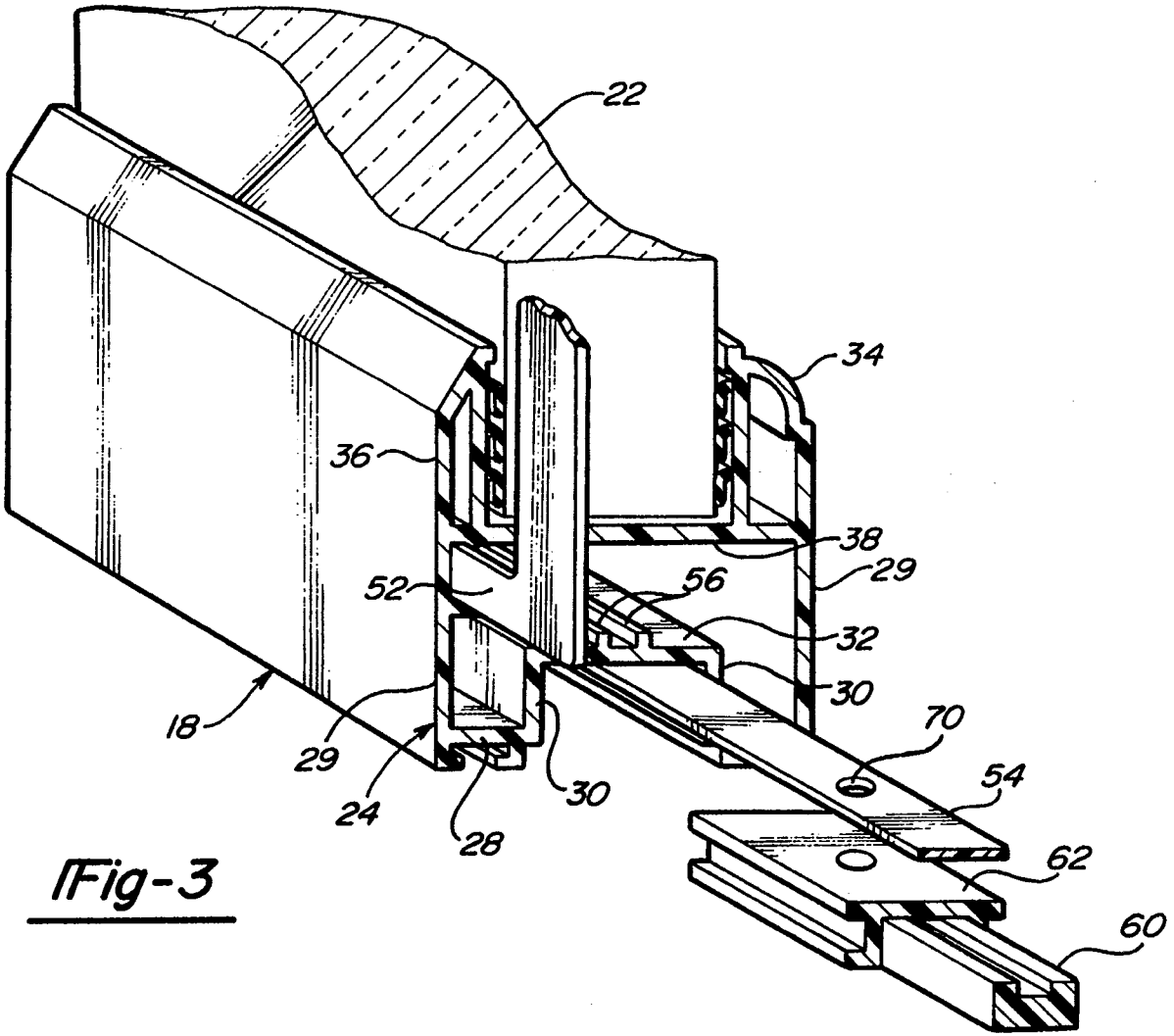
FIG. 3 is a fragmentary perspective view of the sash lower frame member.

A double hung window is shown in FIG. 1 and designated generally at 10. Window 10 includes a rectangular frame 12 in which a lower sash 14 and an upper sash 16 are mounted. The lower and upper sashes are vertically movable within the frame from their respective positions in a conventional manner for a double hung window. While the invention is shown and described in the context of a double hung window, the sash of the present invention can be used in other window types such as casement windows. The lower and upper sashes are constructed according to the present invention and include four frame members 18, each having mitered ends 20 cut at a 45° angle. The frame members are positioned in end-to-end relationship forming a rectangular frame surrounding a window pane 22 made of glass, plexiglass or the like.

The structure of sash 14 is shown in greater detail in FIG. 2. This figure illustrates a sectional view of the sash 14 taken through both the upper and lower frame members 18. The cross sectional shapes of the frame members are substantially identical to one another although it is not necessary that they be exactly identical. Certain variations may exist for the installation of various hardware and seals necessary for the window which do not impact the present invention. The frame members are made of a structural plastic and are preferably extruded to have a substantially uniform cross section along the length of each frame member. As used throughout the specification and claims, the term "plastic" is used in a broad sense to include frame members made solely of plastic resin or made of a plastic composite in which fibers or other materials are molded into the plastic resin.

The cross sectional shape of the frame members is that of a closed hollow body 24, generally rectangular in shape, formed by an outer peripheral wall 28, an inner wall 38 and spaced side walls 29. A recess 26 extends into the rectangular structure 24 from the outer peripheral wall 28. The recess 26 is formed by a pair of intermediate walls 30 which extend into the rectangular structure 24 from the outer peripheral wall 28 and terminate at a base wall 32 which forms the base of the recess 26. In a preferred form of the invention, the intermediate walls extend generally normal to the outer peripheral wall, forming a recess 26 which is itself generally rectangular.

Two spaced hollow flanges 34 and 36 extend from the inner wall 38 of the rectangular structure 24, forming a groove 40 therebetween. The groove 40 is open toward the interior of the sash frame and receives the peripheral portion of the glass pane 22 to hold the glass pane within the sash frame. A plurality of flexible seals 42 extend from the flanges 34 and 36 into the groove 40 and form a seal between the flanges and the glass pane 22.

The frame members are also formed with slots 44 in the outer peripheral wall 28. For the bottom frame member 18, these slots are used to mount seals 46 which seal the sash 14 in the frame 12. For the upper frame member 18, the slots 44 mount a locking cap 48 used to mount a window lock mechanism 64 to the sash. Another slot 50 is formed on the inside of the hollow rectangular structure 24. The slot 50, at each end of a frame member, receives one leg of an L-shaped corner key 52. The corner keys 52 operate to align the frame members 18 relative to one another in the sash.

The four frame members forming the sash are held together by a tensioned strap 54 which is disposed within the recess 26 and extends around the entire periphery of the sash. The two ends of the strap are then joined together to maintain the tension in the strap. In a preferred embodiment, the strap is made of plastic as opposed to metal to eliminate corrosion. The ends of the strap are joined together by heating, to weld the two ends together. For repair of broken glass, the strap 54 is cut, allowing the frame members to come apart. Once the glass is replaced, the frame is assembled around the glass pane and a new strap is installed around the frame members.

The recess 26 is configured to strengthen the frame members, particularly in bending, to accommodate the load applied to the frame members by the tensioned strap 54. The two intermediate walls 30 forming the recess add stiffness to the frame member and are themselves placed in tension by the strap 54. Reinforcing ribs 56 are formed on the base wall 32 opposite from the strap 54 to increase the bending stiffness of the base wall 32. Without the recess 26 or with a shallow recess only as deep as the thickness of the tension band 54, the load applied to the frame members from the band would produce deflection of the outer peripheral wall 28. The reinforcement of the frame members by the intermediate walls 30 of the recess 26 eliminates deflection of the outer peripheral wall.

The recess 26 also provides a space for mounting additional functional components of a window such as a pivot bar 60 and pivot bar holder 62 along the bottom of sash 14 which are used for a tilting double hung window. The recess 26 in the upper frame member 18 is used to mount the lock mechanism 64 operable by handle 66 to lock the upper and lower sashes to one another. The lock and the pivot bar are mounted to the frame members by fasteners 68 which extend through apertures 70 in the tensioned band 54 and into the base wall 32 of recess 26.

In a preferred form, the recess is in the center of the outer peripheral wall as shown. The width of the recess is approximately one half of the width of the outer peripheral wall and the recess depth is between one third and one half of the depth of the hollow rectangular body 24.

The window sash of the present invention thus provides a window that is easy to assemble, having the benefits of an extruded metal frame without the disadvantage of condensation. The sash is easy to disassemble and reassemble for repair of broken glass. The unique structure of the recess for the tensioned band provides the necessary added strength to the extruded plastic frame members to support the load from the tensioned band.

It is to be understood that the invention is not limited to the exact construction illustrated and described above, but that various changes and modifications may be made without departing from the spirit and scope of the invention as defined in the following claims.

I claim:

1. A frame for a generally planar article comprising:

a plurality of extruded plastic frame members having mitered ends and arranged in end-to-end relationship to form a closed frame surrounding said planar article, said frame members having a substantially identical cross sectional shape forming a closed hollow body defined in part by an outer peripheral wall and a recess in said outer peripheral wall extending into said closed hollow body, said recess being formed by a pair of spaced intermediate walls connected to said outer peripheral wall and extending therefrom into said closed hollow body and terminating in a base wall connecting said intermediate walls to one another; and a tensioned band disposed in said recess firmly engaging said base walls of said frame members and extending around said frame for maintaining said frame members in said end-to-end relationship.

2. The frame of claim 1 wherein said tensioned band is made of plastic and has two ends which are attached to one another to maintain the tension in said band.

3. The frame of claim 2 wherein said ends of said plastic band are heat welded together.

4. The frame of claim 1 wherein said spaced intermediate walls of said recess extend inwardly into said closed hollow body substantially normal to said outer peripheral wall.

5. The frame of claim 1 wherein said closed hollow body is generally rectangular and is formed by said peripheral wall, a pair of spaced side walls and an inner wall.

6. The frame of claim 5 further comprising:

means projecting from said inner wall forming a groove for receiving a periphery of said article being framed.

7. A window sash comprising:

a window pane having a periphery;

a frame surrounding said pane comprising a plurality of extruded plastic frame members having mitered ends and arranged in end-to-end relationship to form a closed frame surrounding said pane, said frame members having a substantially identical cross sectional shape forming a hollow body defined in part by an outer peripheral wall and a recess extending into said hollow body from said outer peripheral wall, said recess being formed by a pair of spaced intermediate walls connected to said outer peripheral wall and extending therefrom into said hollow body and terminating in a base wall connecting said intermediate walls to one another, and means projecting from said hollow body forming a groove open inwardly of said closed frame for receiving said periphery of said pane to mount said pane within said frame; and a tensioned band disposed in said recess firmly engaging said base walls of said frame members and extending around said frame for maintaining said frame members in said end-to-end relationship.

8. The window sash of claim 7 wherein said tensioned band is made of plastic and has two ends which are attached to one another by heat welding to maintain the tension in said band.

9. The window sash of claim 8 further comprising at least one reinforcing rib formed on said base wall and extending into said hollow body.

10. The window sash of claim 7 wherein said means projecting from said hollow body forming a groove for receiving said periphery of said glass pane comprises a pair of spaced flanges extending from said hollow body.

11. The window sash of claim 7 further comprising at least one slot extending the length of said frame members along said outer peripheral wall and open outwardly for mounting a window seal to said frame.

12. The window sash of claim 7 further comprising:

a channel extending the length of said frame members within said hollow body; and a corner key having a pair of legs extending at an angle relative to one another for insertion into said channels of a pair of adjacent frame members at the ends thereof to align said adjacent frame members with one another.

13. A window sash comprising:

a generally planar window pane;

a rectangular frame surrounding said pane comprising four elongated extruded plastic frame members having mitered ends cut forty five degree angles and arranged in end-to-end relationship to form said frame, said frame members having a substantially identical cross sectional shape forming a generally rectangular hollow body defined by an outer peripheral wall, a pair of spaced side walls and an inner wall, said outer peripheral wall having a recess extending therefrom into said hollow body, said recess being formed by a pair of spaced intermediate walls connected to said outer peripheral wall and projecting into said rectangular hollow body and terminating in a base wall connecting said intermediate walls to one another;

said frame members further having means forming a groove open inwardly of said closed rectangular frame for receiving said periphery of said pane to mount said pane within said frame; and a tensioned band disposed in said recess firmly engaging the base walls of said recesses in said frame members and extending around said rectangular frame for maintaining said frame members in said end-to-end relationship.

14. The window sash of claim 13 wherein said recess is disposed approximately in the center of said outer peripheral wall.

15. The window sash of claim 13 wherein said generally rectangular hollow body has a width dimension measured between said spaced side walls and said recess has a width dimension measured in the same direction approximately one half of the width of said generally rectangular hollow body.

16. The window sash of claim 13 wherein said generally rectangular hollow body has a depth measured in a direction normal to said outer peripheral wall and said recess has a depth measured in the same direction which is between one third and one half of the depth of said generally rectangular hollow body.

17. The window sash of claim 13 further comprising at least one reinforcing rib formed on said base wall and extending into said generally rectangular hollow body.

* * * * *